US008522652B2

(12) United States Patent
Wang

(10) Patent No.: US 8,522,652 B2
(45) Date of Patent: Sep. 3, 2013

(54) SPRING FOR A RATCHET WRENCH

(76) Inventor: Tzu-Chien Wang, Tainan (TW)

( * ) Notice: Subject to any disclaimer, the term of this patent is extended or adjusted under 35 U.S.C. 154(b) by 195 days.

(21) Appl. No.: 13/289,825

(22) Filed: Nov. 4, 2011

(65) Prior Publication Data

US 2013/0112047 A1 May 9, 2013

(51) Int. Cl.
*B25B 13/46* (2006.01)

(52) U.S. Cl.
USPC ..... 81/63; 81/60

(58) Field of Classification Search
USPC ..... 81/60–63.2
See application file for complete search history.

(56) References Cited

U.S. PATENT DOCUMENTS 5,522,288 A * 6/1996 Slusar et al. ..... 81/63
6,109,141 A * 8/2000 Nurmi ..... 81/63
6,282,991 B1 * 9/2001 Hu ..... 81/63.2
7,263,919 B2 * 9/2007 Arnold ..... 81/63.2
7,311,019 B2 * 12/2007 Arnold et al. ..... 81/63.2

* cited by examiner

*Primary Examiner* — David B Thomas

(57) ABSTRACT

A ratchet wrench includes ratchet wheel rotatably received in a compartment of a body. A pawl is movably received in the compartment and includes a first side having a toothed section engaged with teeth of the ratchet wheel and a second side having a pressing face. A switch is pivotably mounted to the body and operatively connected to a first end of a spring. A second end of the spring presses against the pressing face of the pawl. The spring is a helical compression spring including an intermediate section between the first and second ends. Each of the first and second ends and the intermediate section includes a plurality of adjoining turns. The adjoining turns of the intermediate section are spaced from each other and form a compressible portion. The adjoining turns of the second end of the spring abut against each other and have no gaps therebetween.

2 Claims, 5 Drawing Sheets

SPRING FOR A RATCHET WRENCH

BACKGROUND OF THE INVENTION

The present invention relates to a spring for a ratchet wrench and, more particularly, to a spring that provides enhanced movement stability and that reduces the costs of a ratchet wrench using the spring.

FIG. 5 shows a conventional ratchet wrench including a body 1', a ratchet wheel 2', a pawl 3', a pressing member 4', a spring 5', and a switch 6'. The body 1' includes a compartment 11' receiving the ratchet wheel 2' and the pawl 3'. The ratchet wheel 2' is rotatable relative to the body 1' and includes a plurality of teeth 21' on an outer periphery thereof. A coupling portion 22' is provided on a central portion of the ratchet wheel 2' for coupling with a tool such as a socket. The pawl 3' is pivotably mounted to the body 1' and includes a first side having a toothed section 31' for engagement with the teeth 21' of the ratchet wheel 2' and a second side having a pressing face 32'. The pressing member 4' is made of a rigid material and presses against the pressing face 32'. The spring 5' is a compression spring and includes a first end pressing against the pressing member 4' and a second end engaged with the switch 6'. The switch 6' is pivotably mounted to the body 1' and can be pivoted to move the spring 5' and the pressing member 4'. The pressing member 4' presses against the pressing face 32' of the pawl 3' and causes pivotal movement of the pawl 3' between first and second positions. The toothed portion 31' is engaged with the teeth 21' of the ratchet wheel 2' so that the ratchet wheel 2' can only rotate in a first direction when the pawl 3' is in the first position and that the ratchet wheel 2' can only rotate in a second direction reverse to the first direction when the pawl 3' is in the second position.

However, positioning of the pressing member 4' on the first end of the spring 5' is not reliable. Namely, the pressing member 4' is liable to fall from the spring 5'. Furthermore, actuation of the pawl 3' requires transmission of the spring 5' and the pressing member 4' such that the switching movement is not smooth due to a shift in the contact position between the pressing member 4' and the spring 5'.

BRIEF SUMMARY OF THE INVENTION

An objective of the present invention is to provide a ratchet wrench having enhanced movement stability and reduced costs.

A ratchet wrench according to the present invention includes a body, a ratchet wheel, a pawl, a pressing member, and a spring. The ratchet wheel is received in a compartment of the body and rotatable relative to the body. The ratchet wheel includes a plurality of teeth on an outer periphery thereof. The pawl is received in the compartment and movable relative to the body. The pawl includes a first side having a toothed section for engagement with the plurality of teeth of the ratchet wheel and a second side having a pressing face. The switch is pivotably mounted to the body and operatively connected to a first end of the spring. The switch is operable to cause a second end of the spring to press against the pressing face of the pawl, causing pivotal movement of the pawl between first and second positions. The toothed portion is engaged with the plurality of teeth of the ratchet wheel so that the ratchet wheel can only rotate in a first direction when the pawl is in the first position and that the ratchet wheel can only rotate in a second direction reverse to the first direction when the pawl is in the second position. The spring is a helical compression spring including the first and second ends and an intermediate section between the first and second ends. Each of the first and second ends and the intermediate section includes a plurality of adjoining turns. The plurality of adjoining turns of the intermediate section is spaced from each other and forms a compressible portion. The plurality of adjoining turns of the second end of the spring abuts against each other and has no gaps therebetween.

Preferably, the plurality of adjoining turns of the first end of the spring abuts against each other and has no gaps therebetween.

The present invention will become clearer in light of the following detailed description of illustrative embodiments of this invention described in connection with the drawings.

DETAILED DESCRIPTION OF THE INVENTION

Figure 1:
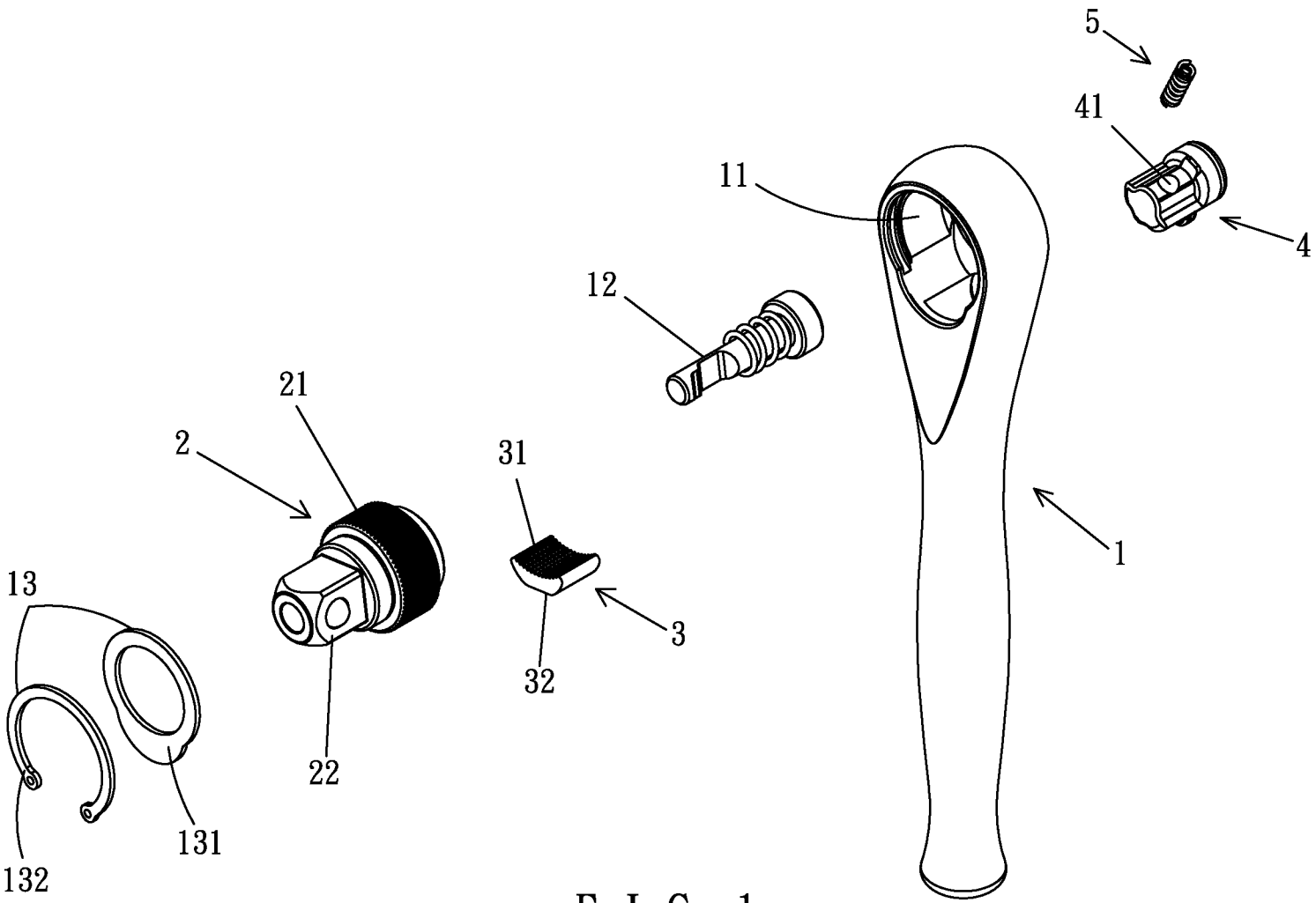
FIG. 1 shows an exploded perspective view of a ratchet wrench according to the present invention.
Figure 2:
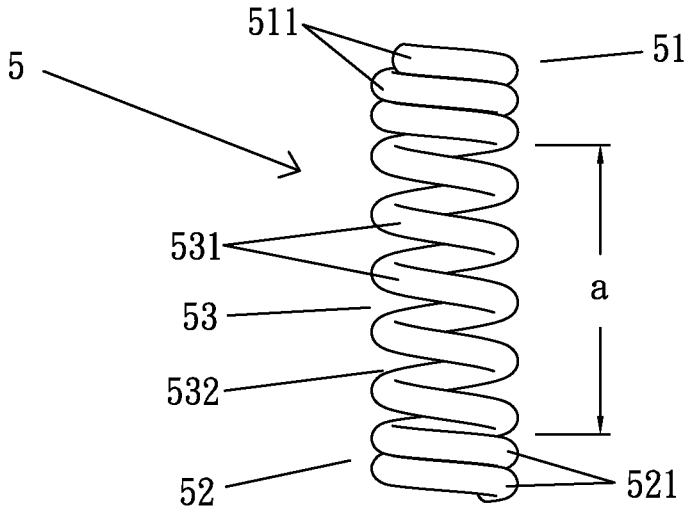
FIG. 2 shows a perspective view of a spring of the ratchet wrench of FIG. 1.
Figure 3:
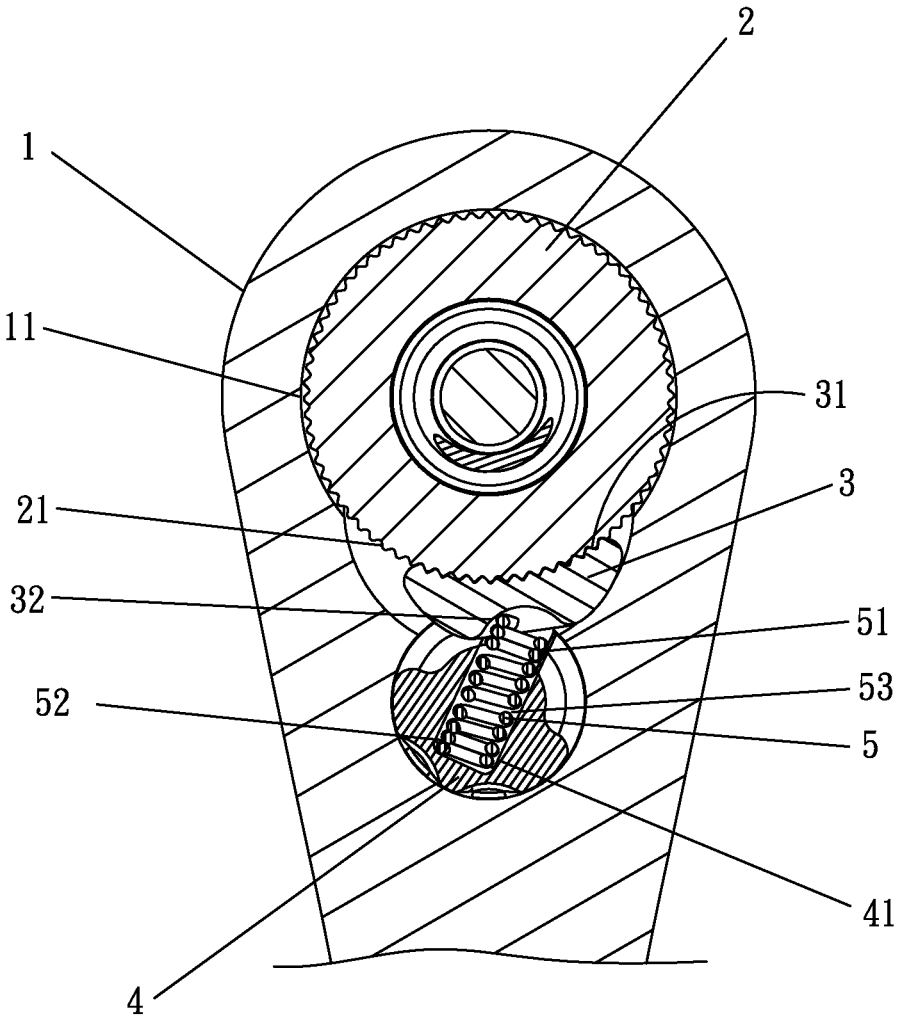
FIG. 3 shows a partial, cross sectional view of the ratchet wrench of FIG. 1.

With reference to FIGS. 1-3, a ratchet wrench according to the present invention includes a body 1, a ratchet wheel 2, a pawl 3, a pressing member 4, and a spring 5. The body 1 includes a compartment 11 receiving the ratchet wheel 2 and the pawl 3. The body 1 further includes a push pin 12 and a positioning device 13 in the form including a retainer cap 131 and a C-ring 132. The push pin 12 and the positioning device 13 are conventional. The ratchet wheel 2 is received in the compartment 11 and rotatable relative to the body 1. The ratchet wheel 2 includes a plurality of teeth 21 on an outer periphery thereof. A coupling portion 22 is provided on a side of the ratchet wheel 2 for coupling with a tool such as a socket. Disengagement of the socket from the coupling portion 22 can be controlled by operating the push pin 12, which is conventional. The pawl 3 is received in the compartment 11 and movable relative to the body 1. The pawl 3 includes a first side having a toothed section 31 for engagement with the teeth 21 of the ratchet wheel 2 and a second side having a pressing face 32. The switch 4 is pivotably mounted to the body 1 and includes a receptacle 41 receiving the spring 5.

Figure 4:
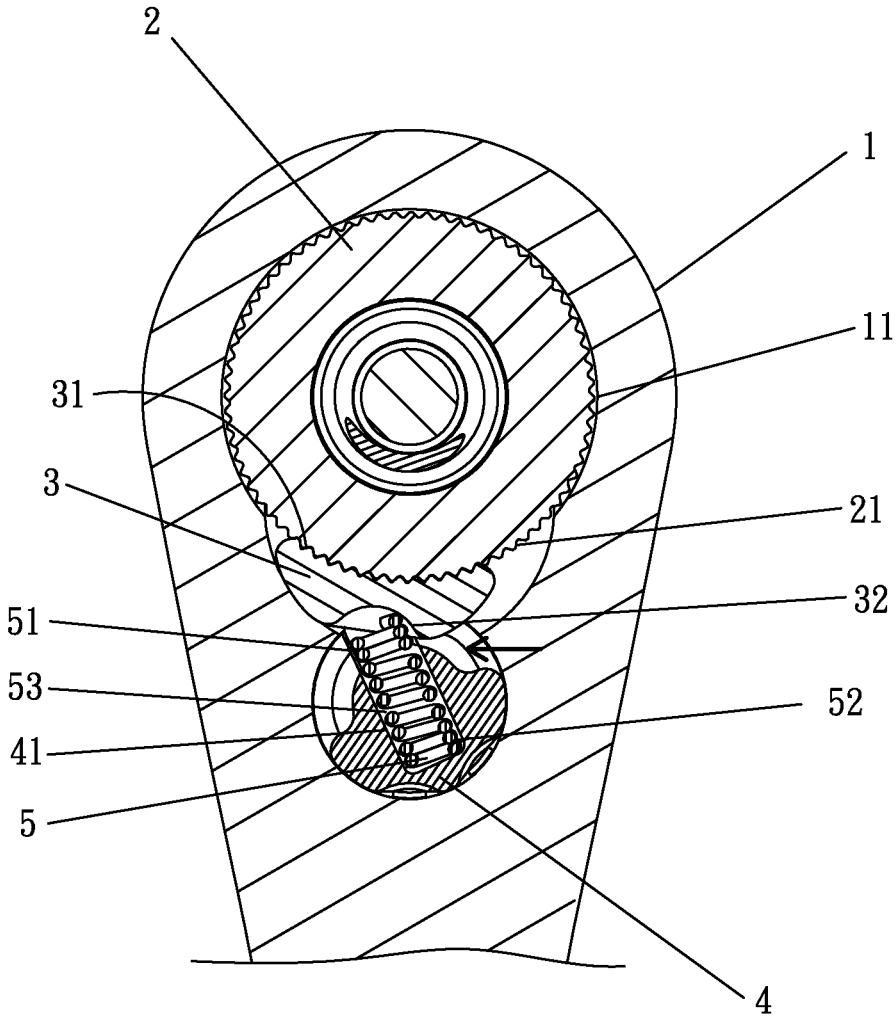
FIG. 4 shows a cross sectional view similar to FIG. 3, with a pawl moved to another position upon operation of a switch.
Figure 5:
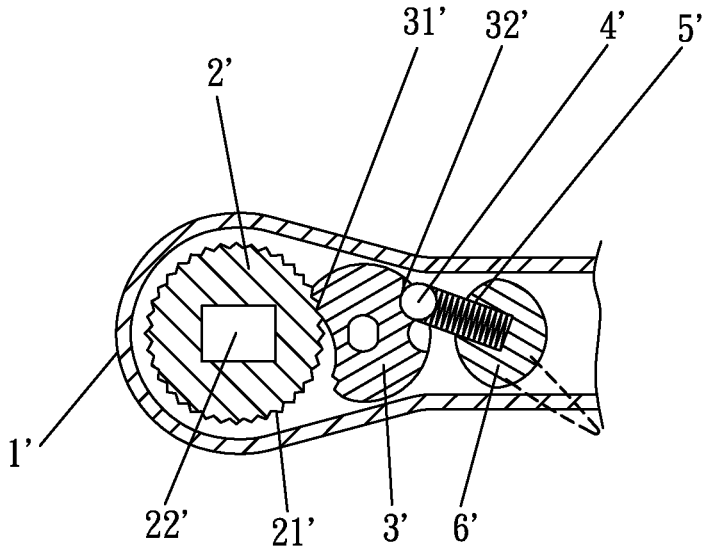
PRIOR ART F I G . 5
FIG. 5 shows a partial, cross sectional view of a conventional ratchet wrench.

With reference to FIGS. 2-4, the spring 5 is a helical compression spring and includes two ends 51 and 52 and an intermediate section 53 between the ends 51 and 52. Each of the ends 51 and 52 and the intermediate section 53 includes a plurality of adjoining turns 511, 521, and 531. The adjoining turns 531 of the intermediate section 53 are spaced from each other (see gaps 532 between adjacent turns 531) and form a compressible portion a. The adjoining turns 511, 521 of each end 51, 52 of the spring 5 abut against each other and have no gaps therebetween. Thus, each end 51, 52 is not easy to deform. Furthermore, the spring 5 can be mounted without considering the direction of the spring 5. Namely, either end 51, 52 can press against the pawl 3 to provide sufficient pressing strength, providing enhanced assembling convenience. In the form shown, the end 51 of the spring 5 presses against the pawl 3. However, the spring 5 can be mounted in a reverse direction to press against the pawl 3 by the other end 52.

The switch 4 and can be pivoted to move the spring 5 that presses against the pressing face 32 of the pawl 3 and causes pivotal movement of the pawl 3 between first and second positions. The toothed portion 31 is engaged with the teeth 21 of the ratchet wheel 2 so that the ratchet wheel 2 can only rotate in a first direction when the pawl 3 is in the first position and that the ratchet wheel 2 can only rotate in a second direction reverse to the first direction when the pawl 3 is in the second position.

After assembly, since deformation of the end 51 of the spring 5 is not easy, the pawl 3 can be moved by the spring 5 when the switch 4 is pivoted for changing the operative direction of the ratchet wrench. The compressible intermediate section 53 of the spring 5 assures reliable engagement between the pawl 3 and the ratchet wheel 2 while the pawl 3 and/or the ratchet wheel 2 are moved. The pressing member required in the conventional design is not used. Thus, the costs are reduced, and the assembling inconvenience is mitigated. Furthermore, the operational stability is enhanced due to direct pressing against the pawl 3 by the spring 5.

It can be appreciated that only one of the ends 51 and 52 of the spring 5 having adjoining turns 511, 521 is sufficient to achieve the above advantages. Furthermore, the ratchet wheel 2, the pawl 3, and the switch 4 can be of other shapes and structures different from those shown in the drawings.

Although specific embodiments have been illustrated and described, numerous modifications and variations are still possible without departing from the essence of the invention. The scope of the invention is limited by the accompanying claims.

The invention claimed is:

1. A ratchet wrench comprising a body, a ratchet wheel, a pawl, a pressing member, and a spring, with the body including a compartment, with the ratchet wheel received in the compartment and rotatable relative to the body, with the ratchet wheel including a plurality of teeth on an outer periphery thereof, with the pawl received in the compartment and movable relative to the body, with the pawl including a first side having a toothed section for engagement with the plurality of teeth of the ratchet wheel and a second side having a pressing face, with a switch pivotably mounted to the body and operatively connected to a first end of the spring, with the switch operable to cause a second end of the spring to press against the pressing face of the pawl, causing pivotal movement of the pawl between first and second positions, with the toothed portion engaged with the plurality of teeth of the ratchet wheel so that the ratchet wheel can only rotate in a first direction when the pawl is in the first position and that the ratchet wheel can only rotate in a second direction reverse to the first direction when the pawl is in the second position, with the spring being a helical compression spring including the first and second ends and an intermediate section between the first and second ends, with each of the first and second ends and the intermediate section including a plurality of adjoining turns, with the plurality of adjoining turns of the intermediate section spaced from each other and forming a compressible portion, with the plurality of adjoining turns of the second end of the spring abutting against each other and having no gaps therebetween.

2. The ratchet wrench as claimed in claim 1, with the plurality of adjoining turns of the first end of the spring abutting against each other and having no gaps therebetween.

* * * * *